US006676995B2

(12) United States Patent
Dick et al.

(10) Patent No.: US 6,676,995 B2
(45) **Date of Patent: *Jan. 13, 2004**

(54) SOLUTION STRIPING SYSTEM

(75) Inventors: Kenneth W. Dick, San Ramon, CA (US); Gary Otake, Union City, CA (US); Aaron Jessen, Campbell, CA (US)

(73) Assignee: LifeScan, Inc., Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/187,075

(22) Filed: Jun. 28, 2002

(65) Prior Publication Data

US 2003/0099773 A1 May 29, 2003

Related U.S. Application Data

(62) Division of application No. 09/997,315, filed on Nov. 28, 2001.

(51) Int. Cl.[7] ..... B05D 1/26
(52) U.S. Cl. ..... 427/286; 427/420
(58) Field of Search ..... 427/286, 2–31, 427/358, 420, 434.2; 118/410, 411, 419; 422/57

(56) References Cited

U.S. PATENT DOCUMENTS

| | | | |
|---|---|---|---|
| 3,032,008 A | | 5/1962 | Land et al. |
| 3,886,898 A | | 6/1975 | Colegrove et al. |
| 3,920,862 A | * | 11/1975 | Damschroder et al. |
| 4,106,437 A | | 8/1978 | Bartlett |
| 4,224,125 A | | 9/1980 | Nakamura et al. |
| 4,343,835 A | * | 8/1982 | Jones et al. |
| 4,476,165 A | * | 10/1984 | McIntyre |

(List continued on next page.)

FOREIGN PATENT DOCUMENTS

| | | |
|---|---|---|
| CA | 770540 | 10/1967 |
| EP | 0 829 575 A1 | 3/1998 |
| GB | 384293 | 2/1981 |
| RU | 413053 | 6/1974 |
| WO | WO 97/18465 | 11/1995 |
| WO | WO 99/49307 | 3/1998 |

OTHER PUBLICATIONS

Cl, et al. "Spectrofluorimetric Determination of hydrogen Peroxide Based on the Catalytic Effect of Peroxidase–like Manganese Tetrakis(sulphophenyl) Porphyrin on the Oxidation of Homovanillic Acid" Analystica Chimica Acta; 233(1990) pp. 229–302.

Zaitsu, et al., "New Fluorogenic Substrates for Horseradish Peroxidase: Rapid and Sensitive Assays for Hydroden Peroxide and Peroxidase" Analytical Biochemistry 109, pp. 109–113 (1980).

*Primary Examiner*—Fred J. Parker
(74) *Attorney, Agent, or Firm*—Frank P. Becking; Boziecevic, Field & Francis LLP

(57) ABSTRACT

A method for laying down stripes of solution on substrate is described. The substrate preferably comprises a web of material set on a backing roller passed by a specially configured die. The die includes at least a mouth with lips extending beyond a face or body of the die. The die is adapted to avoid fluid leakage therefrom. Upper and lower portions of the die defining the mouth are preferably substantially flat and mirror images of each other. The lips are preferably placed in close proximity to the material on which the solution is to be deposited. Solution passing through the mouth of the die is directed to the webbing and deposited in a substantially constant thickness stripe or band. Often, the solution comprises a reagent-type solution. The solution coating is typically dried onto the substrate. Dried product may then be used in reagent test strip production.

7 Claims, 6 Drawing Sheets

U.S. PATENT DOCUMENTS 4,545,382 A 10/1985 Higgins et al.
4,628,856 A 12/1986 Burgdorf
4,675,230 A * 6/1987 Innes
4,735,169 A * 4/1988 Cawston et al.
4,844,004 A * 7/1989 Hadzimihalis et al.
4,935,346 A 6/1990 Phillips et al.
5,266,179 A 11/1993 Nankai et al.
5,290,515 A * 3/1994 Plesch et al.
5,304,468 A 4/1994 Phillips et al.

* cited by examiner

SOLUTION STRIPING SYSTEM

CROSS-REFERENCE TO RELATED APPLICATIONS

This is a Divisional of co-pending U.S. patent application Ser. No. 09/997,315 filed Nov. 28, 2001, the benefit of which dated is claimed hereby.

FIELD OF THE INVENTION

This invention relates to approaches for depositing chemical compositions on substrate in solution form. The invention is particularly suited for depositing solution to be dried on substrate for use in producing reagent test strips.

BACKGROUND OF THE INVENTION

Analyte detection assays find use in a variety of applications including clinical laboratory testing, home testing, etc., where the results of such testing play a prominent role in the diagnosis and management of a variety of conditions. The more common analytes include glucose, alcohol, formaldehyde, L-glutamic acid, glycerol, galactose, glycated proteins, creatinine, ketone body, ascorbic acid, lactic acid, leucine, malic acid, pyruvic acid, uric acid and steroids. Analyte detection is often performed in connection with physiological fluids such as tears, saliva, whole blood and blood-derived products. In response to the growing importance of analyte detection, a variety of analyte detection protocols and devices for both clinical and home use have been developed. Many detection protocols employ a reagent test strip to detect analyte in a sample.

In producing reagent test strips, one or more stripes of reagent is typically applied to a substrate and dried. The substrate often comprises a continuous web of material proceeding from a coating station, passing reagent drying features and take up on a roll. Coated substrate is often then associated with other elements and singulated to produce individual test strips. In this production scheme, an area of particular importance lies in suitable application of reagent to the substrate.

This is important for a number of reasons, ranging from economic considerations to safety. Clearly, precision in laying-down reagent will result in less waste of material that is often costly. Further, an ability to consistently lay down reagent coating will provide for test strips delivering more consistent results, better enabling appropriate response by a user or a physician.

Whether used in producing reagent test strips or otherwise, the present invention is more able to produce consistent and controlled solution striping than existing coaters. Existing coaters-over which the present invention offers improvement-include, grooved roller arrangements and examples as presented in British Pat. No. 384,293; Canadian Pat. No. 770,540; Russian Pat. No. 413,053; and U.S. Pat. Nos. 3,032,008, 3,886,898 and 4,106,437.

According to the text of the '437 patent, each of the other referenced approaches encounter difficulties in achieving precise control of stripe width and registration. Further, they are characterized as unduly complex and/or difficult to maintain.

While the device in the '437 patent is said not to suffer such drawbacks and to be capable of carrying out multiple stripe coating of a web at high speeds and with a high degree of precision, much greater precision has been observed in practicing the present invention when depositing very low viscosity solutions. Furthermore, in using low viscosity solutions, the present invention is more forgiving with respect to setup, tolerating greater inconsistency in spacing between the substrate to be coated and the point(s) of solution delivery from the die. Also, the present invention offers a far more durable solution since fragile extension from the die are not employed.

Another die for slot coating produced by Troller Schweizer Engineering Ag (Murganthal, Switzerland) is more similar to the present invention in some respects than the die described in the '437 patent. Due to certain structural similarities, comparable performance in stripe width deposition may be obtained when set up properly. However, die setup is often difficult due to the layered construction of the device. Even when set up properly though, the use of vertically-oriented sections in the die introduce significant leakage problems in coating substrate with low viscosity solution. Especially where costly reagent materials are concerned, such leakage is clearly economically disadvantageous. Leakage also introduces another variable in solution management making it more difficult to lay down consistent width and thickness stripes or bands of solution.

Prior to the present invention, in particular the challenges associated with slot coating low viscosity solutions were not appreciated. As the invention itself is the first known application of slot coating technology to low viscosity solutions in the range of 0.50 to 5.0 centipoises, the problems solved by features described herein were appreciated only in connection the present invention. While the '437 patent is silent to what viscosity solution may be employed with the die, it cites examples of typically higher viscosity fluids including solutions or dispersions of polymeric material containing a die or pigment, magnetic dispersions, phosphor dispersions, radiation-sensitive photographic emulsions and adhesive compositions. Troller dies most often find use in laying down viscous inks, pastes and plastics.

Accordingly, the present invention provides a significant advance in precision solution coating, especially with low or very low viscosity solutions. Those with skill in the art may well appreciate further advantages or possible utitlity in connection with the features herein. Whatever the case, it is contemplated that some variations of the invention may only afford certain advantages, while others will present each of them.

SUMMARY OF THE INVENTION

Features of the invention provide for accurate coating of material with bands or stripes of solution with a slot coating die. Often, the substrate material comprises webbing passed by the specially-configured die. The webbing may be supported on a backing roller to locate the webbing in close proximity to the front of the inventive die. To deposit solution on the webbing in one or more stripes or bands, solution under pressure is extruded or pushed out of the die.

The die preferably comprises two body portions in opposition with a spacer or shim therebetween. In such cases, channel(s) provided in the shim define flow path(s) to the front of the die. At the front of the die, at least one open mouth, preferably formed by substantially parallel roof and floor portions, terminates in lips that are preferably perpendicular to the roof and floor portions. Such a mouth/lip arrangement may also be provided without the use of a shim by integrating the supply channels in the die.

Each of the elements of the die may be provided by separate pieces so long as they are stacked in a substantially horizontal manner when in use. So long as no drain for coating solution is introduced by the arrangement of elements making up the die, the configuration may be varied or characterized otherwise. However produced or characterized, the mouth and lip aspects of the die enable laying down a precision coating of solution.

The present invention includes systems comprising any of these features described herein. Furthermore, complete manufacturing systems including production systems and coated product form aspects of the present invention. Product may take the form of coated webbing or completed test strips. Methodology described herein also forms part of the invention.

BRIEF DESCRIPTION OF THE DRAWINGS

Each of the following figures provide examples diagrammatically illustrating aspects of the present invention. Like elements in the various figures are indicated by identical numbering. For the sake of clarity, some such numbering may be omitted.

DETAILED DESCRIPTION OF THE INVENTION

Before the present invention is described in detail, it is to be understood that this invention is not limited to the particular variations set forth and may, of course, vary. Various changes may be made to the invention described and equivalents may be substituted without departing from the true spirit and scope of the invention. In addition, many modifications may be made to adapt to a particular situation, material, composition of matter, process, process step or steps to the objective, spirit and scope of the present invention. All such modifications are intended to be within the scope of the claims made herein. Furthermore, where a range of values is provided, it is understood that every intervening value, between the upper and lower limit of that range and any other stated or intervening value in that stated range is encompassed within the invention. That the upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications, patents and patent applications mentioned herein are incorporated herein in their entirety. The referenced items are provided solely for their disclosure prior to the filing date of the present application. Nothing herein is to be construed as an admission that the present invention is not entitled to antedate such material by virtue of prior invention.

It is also noted that as used herein and in the appended claims, the singular forms "a," "and," and "the" include plural referents unless the context clearly dictates otherwise. In the claims, the terms "first," "second" and so forth are to be interpreted merely as ordinal designations, they shall not be limiting in themselves. Further, the use of exclusive terminology such as "solely," "only" and the like in connection with the recitation of any claim element is contemplated. Also, it is contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

Figure 1:
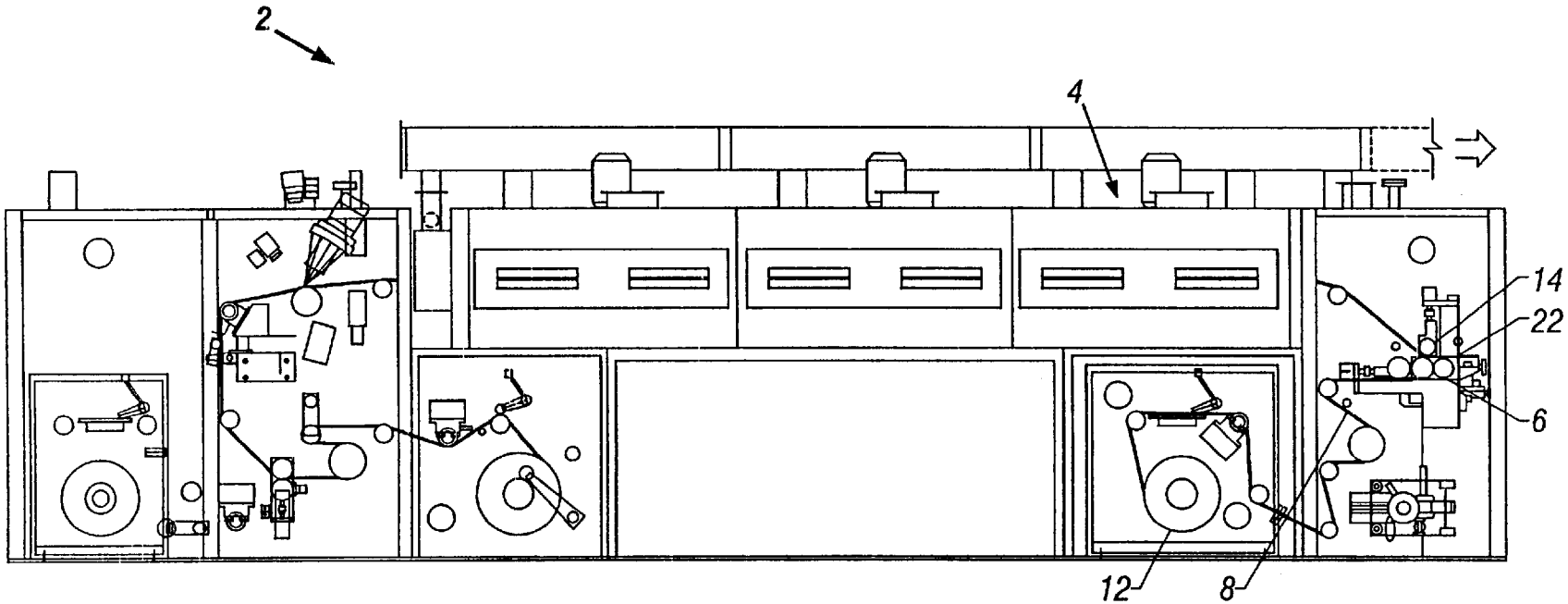
FIG. 1 shows an overview of the inventive system from the side.

Turning now to FIG. 1, elements of the present invention are shown in system manufacturing system (2). The system shown is a model TM-MC3 system produced by Hirano Tecseed Co. Ltd (Nara, Japan) adapted for use with the present invention. Preferably, it includes such drying features in a drying section (4) as described in U.S. patent application, titled "Solution Drying System," to the inventors of the present invention, filed on even date herewith.

Irrespective of such details as may be incorporated in the present invention, features of particular interest include die (6) and a substrate or webbing material (8) upon which solution (10) is deposited in stripes or bands. Optimally, material (8) is provided in the form of a web by way of supply reel (12) and associated feed rollers. Preferably, it is passed by die (6) upon backing roller (14) as indicated variously by arrows in the figures.

For use in producing test strips, substrate or webbing (6) preferably comprises a semi-rigid material that is capable of providing structural support to a test strip in which it may be incorporated. The substrate may comprise an inert material like a plastic (e.g., PET, PETG, polyimide, polycarbonate, polystyrene or silicon), ceramic, glass, paper or plastic-paper laminate.

For use in an electrochemical test strip, at least the surface of the substrate that faces a reaction area in the strip will comprise a metal, where metals of interest include palladium, gold, platinum, silver, iridium, carbon, doped indium tin oxide, stainless steel and various alloys of these metals. In many embodiments, a noble metal such as gold, platinum or palladium is used.

Figure 2:
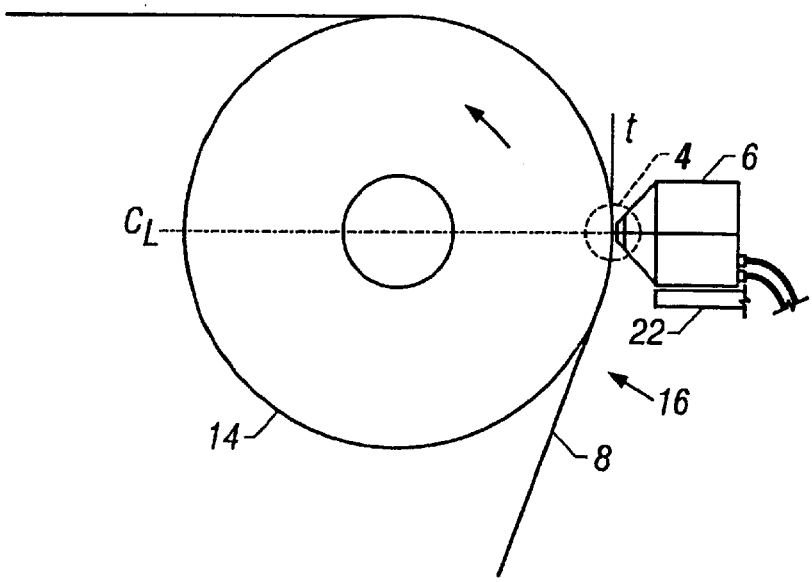
FIG. 2 shows a closeup view of features of the system from the side.
Figure 3:
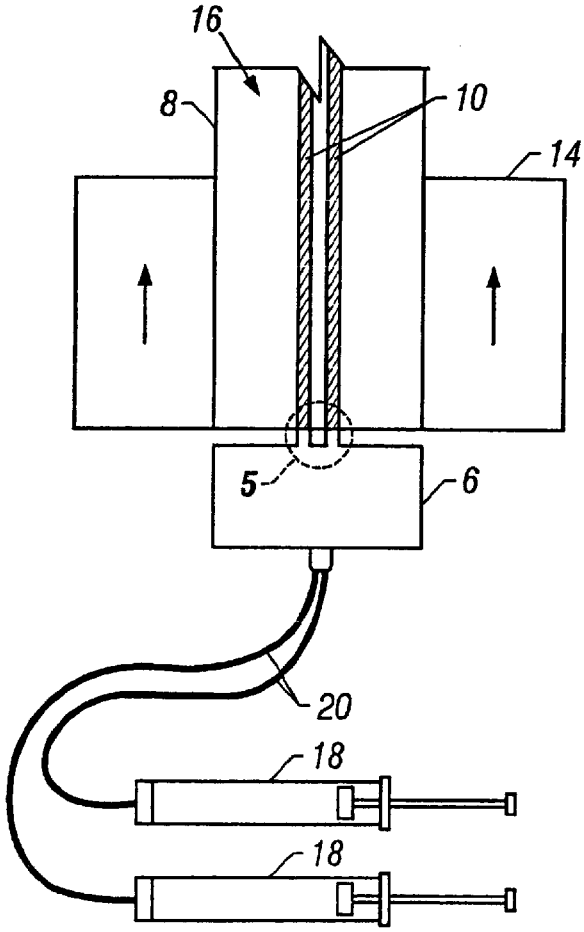
FIG. 3 shows a closeup view of features of the system from the top.
Figure 4:
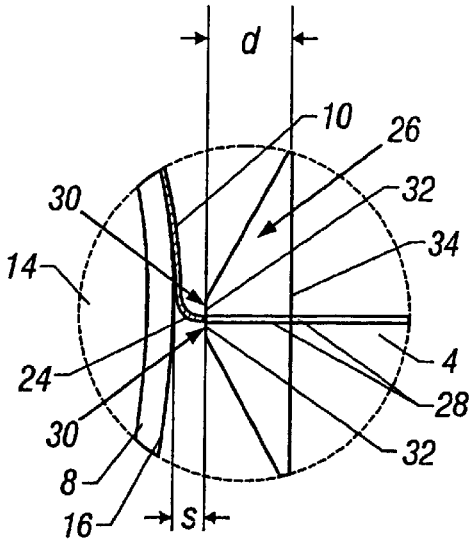
FIG. 4 shows a detail of the inventive die from the side.

In some instances, the substrate itself may be made of metal, especially one of those noted above. It may be preferred, however, that the substrate comprise a composite of a support coated with a metallic and/or conductive coating (such as palladium, gold, platinum, silver, iridium, carbon conductive carbon ink doped tin oxide or stainless steel). Such an arrangement is shown in FIGS. 2–4, in which a metallic coating (16) is set upon a plastic support member (8). For further discussion of substrate or support materials that find use in certain embodiments of the subject invention, see U.S. Pat. Nos. 4,935,346 and 5,304,468.

When a metal-coated support is to be employed as the substrate or webbing material (8), its thickness will typically range from about 0.002 to 0.014 in (51 to 356 $\mu$m), usually from about 0.004 to 0.007 in (102 to 178 $\mu$m), while the thickness of the metal layer will typically range from about 10 to 300 nm and usually from about 20 to 40 nm. A gold or palladium coating may be preferred for this purpose. For ease of manufacture, it may be preferred that the entire surface of substrate (8) is coated with metal.

At least one pump (16) is provided to supply die (6) with solution. Positive displacement or gear pumps are preferred. A most preferred example is a syringe such as produced by Harvard Apparatus, model AH70-2102 (Holliston, Mass.). In fact, a pair of syringes (18) to be driven by an electronically-controlled fixture are preferably used in connection with the most preferred die variation shown in the figures. As shown in FIG. 3, each syringe pump (18) is in communication with a single line (20) feeding solution to die (6). Each supply line provides fluid for laying down a single stripe of solution coating as depicted in FIG. 3. Such a set-up ensures consistent solution delivery in comparison to a trough-type system where impediment in one flow path results in greater flow through other clear flow paths in communication with the same fluid source.

However delivered, the coating composition supplied to die (6) for coating material may vary. In many variations, it comprises one or more reagent members of a signal producing system. A "signal producing system" is one in which one or more reagents work in combination to provide a detectable signal in the presence of an analyte that can be used to determine the presence and/or concentration of analyte. The signal producing system may be a signal producing system that produces a color that can be related to the presence or concentration of an analyte or it may be a signal producing system that produces an electrical current that can be related to the presence or concentration of an analyte. Other types of systems may be used as well.

A variety of different color signal producing systems are known. Representative color signal producing systems of interest include analyte oxidation signal producing systems. An "analyte oxidation signal producing system" is one that generates a detectable colorimetric signal from which the analyte concentration in the sample is derived, the analyte being oxidized by a suitable enzyme to produce an oxidized form of the analyte and a corresponding or proportional amount of hydrogen peroxide. The hydrogen peroxide is then employed, in turn, to generate the detectable product from one or more indicator compounds, where the amount of detectable product produced by the signal producing system, (i.e. the signal) is then related to the amount of analyte in the initial sample. As such, the analyte oxidation signal producing systems useable in the subject test strips may also be correctly characterized as hydrogen peroxide based signal producing systems.

As indicated above, the hydrogen peroxide based signal producing systems include an enzyme that oxidizes the analyte and produces a corresponding amount of hydrogen peroxide, where by the corresponding amount is meant that the amount of hydrogen peroxide that is produced is proportional to the amount of analyte present in the sample. The specific nature of this first enzyme necessarily depends on the nature of the analyte being assayed but is generally an oxidase. As such, the first enzyme may be: glucose oxidase (where the analyte is glucose); cholesterol oxidase (where the analyte is cholesterol); alcohol oxidase (where the analyte is alcohol); lactate oxidase (where the analyte is lactate) and the like. Other oxidizing enzymes for use with these and other analytes of interest are known to those of skill in the art and may also be employed. In those embodiments where the reagent test strip is designed for the detection of glucose concentration, the first enzyme is glucose oxidase. The glucose oxidase may be obtained from any convenient source (e.g., a naturally occurring source such as *Aspergillus niger* or Penicillum), or be recombinantly produced.

The second enzyme of the signal producing system is an enzyme that catalyzes the conversion of one or more indicator compounds into a detectable product in the presence of hydrogen peroxide, where the amount of detectable product that is produced by this reaction is proportional to the amount of hydrogen peroxide that is present. This second enzyme is generally a peroxidase, where suitable peroxidases include: horseradish peroxidase (HRP), soy peroxidase, recombinantly produced peroxidase and synthetic analogs having peroxidative activity and the like. See e.g., Y. Ci, F. Wang; Analytica Chimica Acta, 233 (1990), 299–302.

The indicator compound or compounds are ones that are either formed or decomposed by the hydrogen peroxide in the presence of the peroxidase to produce an indicator dye that absorbs light in a predetermined wavelength range. Preferably the indicator dye absorbs strongly at a wavelength different from that at which the sample or the testing reagent absorbs strongly. The oxidized form of the indicator may be the colored, faintly-colored, or colorless final product that evidences a change in color. That is to say, the testing reagent can indicate the presence of analyte (e.g., glucose) in a sample by a colored area being bleached or, alternatively, by a colorless area developing color.

Indicator compounds that are useful in the present invention include both one- and two-component calorimetric substrates. One-component systems include aromatic amines, aromatic alcohols, azines, and benzidines, such as tetramethyl benzidine-HCl. Suitable two-component systems include those in which one component is MBTH, an MBTH derivative (see for example those disclosed in U.S. patent application Ser. No. 08/302,575, incorporated herein by reference), or 4-aminoantipyrine and the other component is an aromatic amine, aromatic alcohol, conjugated amine, conjugated alcohol or aromatic or aliphatic aldehyde. Exemplary two-component systems are 3methyl-2-benzothiazolinone hydrazone hydrochloride (MBTH) combined with 3-dimethylaminobenzoic acid (DMAB); MBTH combined with 3,5-dichloro-2-hydroxybenzene-sulfonic acid (DCHBS); and 3-methyl-2-benzothiazolinone hydrazone N-sulfonyl benzenesulfonate monosodium (MBTHSB) combined with 8-anilino-1 naphthalene sulfonic acid ammonium (ANS). In certain embodiments, the dye couple MBTHSB-ANS is preferred.

Signal producing systems that produce a fluorescent detectable product or detectable non fluorescent substance (e.g., in a fluorescent background), may also be employed in the invention, such as those described in: Kiyoshi Zaitsu, Yosuke Ohkura: New fluorogenic substrates for Horseradish Peroxidase: rapid and sensitive assay for hydrogen peroxide and the Peroxidase. *Analytical Biochemistry* (1980) 109, 109–113.

Signal producing systems that produce an electric current (e.g., as are employed in electrochemical test strips) are of particular interest to the present invention. Such reagent systems include redox reagent systems, which reagent systems provide for the species that is measured by the electrode and therefore is used to derive the concentration of analyte in a physiological sample. The redox reagent system present in the reaction area typically includes at least enzyme(s) and a mediator. In many embodiments, the enzyme member(s) of the redox reagent system is an enzyme or plurality of enzymes that work in concert to oxidize the analyte of interest. In other words, the enzyme component of the redox reagent system is made up of a single analyte oxidizing enzyme or a collection of two or more enzymes that work in concert to oxidize the analyte of interest. Enzymes of interest include oxidases, dehydrogenases, lipases, kinases, diphorases, quinoproteins, and the like.

The specific enzyme present in the reaction area depends on the particular analyte for which the test strip is designed to detect, where representative enzymes include: glucose oxidase, glucose dehydrogenase, cholesterol esterase, cholesterol oxidase, lipoprotein lipase, glycerol kinase, glycerol-3-phosphate oxidase, lactate oxidase, lactate dehydrogenase, pyruvate oxidase, alcohol oxidase, bilirubin oxidase, unease, and the like. In many preferred embodiments where the analyte of interest is glucose, the enzyme component of the redox reagent system is a glucose oxidizing enzyme, e.g. a glucose oxidase or glucose dehydrogenase.

The second component of the redox reagent system is a mediator component, which is made up of one or more mediator agents. A variety of different mediator agents are known in the art and include: ferricyanide, phenazine ethosulphate, phenazine methosulfate, phenylenediamine, 1-methoxy-phenazine methosulfate, 2,6-dimethyl-1,4-benzoquinone, 2,5-dichloro-1,4-benzoquinone, ferrocene derivatives, osmium bipyridyl complexes, ruthenium complexes, and the like. In those embodiments where glucose is the analyte of interest and glucose oxidase or glucose dehydrogenase are the enzyme components, mediators of particular interest are ferricyanide, and the like.

Other reagents that may be present in the reaction area include buffering agents, citraconate, citrate, malic, maleic, phosphate, "Good" buffers and the like. Yet other agents that may be present include: divalent cations such as calcium chloride, and magnesium chloride; pyrroloquinoline quinone; types of surfactants such as Triton, Macol, Tetronic, Silwet, Zonyl, and Pluronic; stabilizing agents such as albumin, sucrose, trehalose, mannitol, and lactose.

For use in producing electrochemical test strips, a redox system including at least an enzyme and a mediator as described above is preferably used for coating (10). In solution, the system preferably comprises a mixture of about 6% protein, about 30% salts and about 64% water. The fluid most preferably has a viscosity of roughly 1.5 centipoises (cP). However, it is contemplated that the inventive die is advantageously used in coating with solution between about 0.5 and 25 cP. Its advantages are more apparent coating with solution between about 1 and 10 cP, and most apparent in coating with solution between 1 and 5 cP, especially between 1 and 2 cP.

Together FIGS. 2 and 3 illustrate a preferred manner in which to apply solution according to the present invention. Die (6) is shown brought into close proximity to web material (8) riding on backing roller (14). Preferably, die (6) is bolted to an adjustable carriage (22) to repeatably set its placement. A vacuum box may be set around the die mount to facilitate improved bead stability.

Once in place, the die's features may be oriented along a centerline of roller ($^{C}_{L}$) as shown in FIG. 2. For some operations, it is contemplated that the die may be angled relative to tangential surface (t), rather than set-up in a perpendicular fashion as indicated.

In FIG. 3, two stripes or bands of solution (10) are in the process of being laid-down by die (6) as roller (14) advances as indicated. It is however, contemplated that the system may be configured to lay down a single stripe or band of solution; likewise, it is contemplated than die (6) may be configured to lay down many stripes. For laying down more that a pair of stripes of solution, it may be desired to use dies up to 24, 36 or 48 in wide (609.6, 914.4 or 1219.2 mm). The die shown is a standard 2.5 in wide die such as available through Liberty Precision Industries (Rochester, N.Y.) that has been modified with a relieved face to provide for features of the invention.

Figure 5:
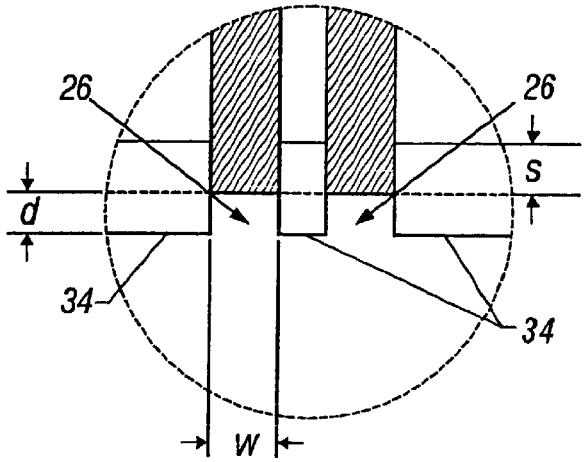
FIG. 5 shows a detail of the inventive die from the top.

Detailed images of the action shown in FIGS. 2 and 3 are shown in FIGS. 4 and 5, respectively. In FIG. 4, a solution bead (24) is shown from the side as it is deposited on webbing (8), after running through a mouth (26) of the die. Mouth (26) is left open at its sides (28). Surface tension at the sides of the mouth limit lateral expansion of passing solution and confine the flow within its bounds. With solution flow so-established, a stripe of comparable width is cleanly deposited on material (8).

Lips (30) with edges (32) are shown in alignment. These features facilitate a clean exit of the solution from the die to form a very precise stripe of solution (10) on web material (8). Behind lips (30), a face (34) of the die is shown. In FIG. 5, these features may be appreciated from above.

In each of FIGS. 4 and 5, a desirable lip-edge/webbing separation(s) is observed. Preferably, gap(s) is maintained between about 0.001 and 0.004 in (25 to 102 $\mu$m) during striping operations. Using solution having a viscosity between about 1 and 2 cP, any spacing within this range will produce consistent striping results. With a solution having a viscosity of roughly 1.5 cP, gap spacing(s) set at 0.003 in (76 $\mu$m) produces optimal results.

Figure 6:
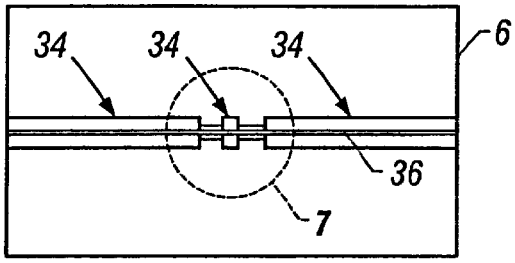
FIG. 6 shows the inventive die from the front.
Figure 7:
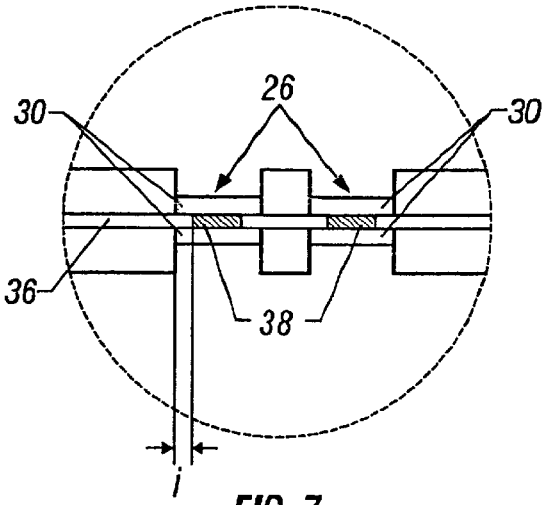
FIG. 7 shows a detail of the inventive die from the front.

FIGS. 6 and 7 help to further illustrate features of mouth (26) in relation to other possible aspects of the die. FIG. 6 clearly shows face portions (26) of die (6). The face of the die may comprise relieved sections from the die body portions and any shim (36) provided therebetween. In FIG. 7, solution outlets (38) between opposing upper and lower portions of mouth (26) are clearly visible. The outlets are preferably the same width or smaller in width than the mouths. Such a configuration ensures that material flowing from the outlets is properly directed across the mouth surfaces (40) and pinned by mouth sides (42) as shown in FIG. 9.

Figure 9:
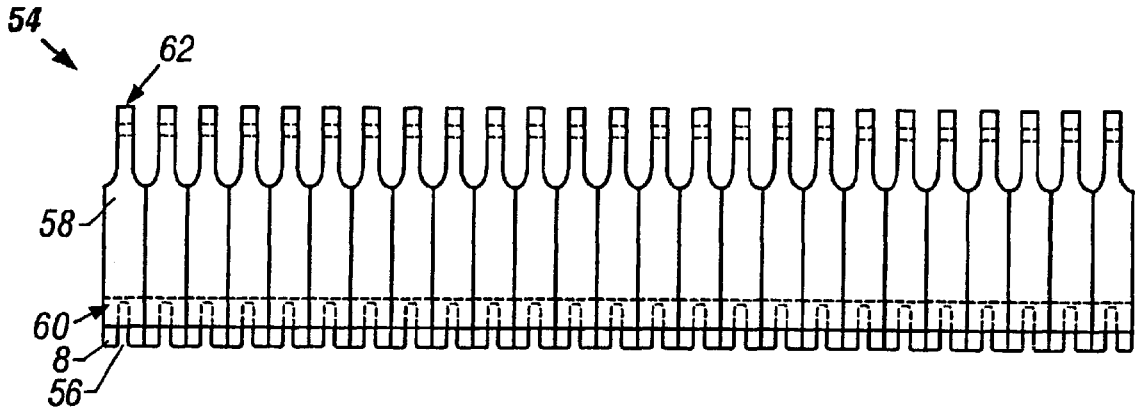
FIG. 9 shows product of the inventive system in an intermediate stage of production.

FIG. 9 further illustrates a preferred manner of constructing the inventive die. Here die body portions (44) are shown broken apart, together with optional shim (36). Shim (36) includes cutouts (46) providing fluid delivery conduits or grooves between the die body portions to outlets (38) when the die is assembled. The shim may comprise PET, stainless steel or another suitable material. The die is preferably bolted together through holes (48) partially shown in dashed lines. Also shown in partial dashed lines are fluid supply conduits (50) running through the body. The conduits terminate at ports (52) positioned to align with the shim cutouts.

Of course, other approaches to die construction are contemplated as well. For instance, a shim may be omitted in favor of cutting fluid supply grooves into either side of the die body to channel solution to feed mouth (26). Alternately, other multi-piece die constructions may be employed. For instance, mouth sections may be provided by pieces separate from main die body members.

In any design in accordance with the present invention, layer(s) used in the construction that results in a groove or capillary in communication with solution (10) will orient the capillary in fashion so solution does not escape from the capillary during die use. When oriented horizontally, fluid drawn into a capillary merely fills the structure and remains stationary. In contrast, with a vertically oriented capillary (such as those present in the Troller die arrangement), fluid fills and drains from the capillary, causing the die to leak.

It is much more difficult to provide consistent solution striping results with a leaky die. Die leakage introduces an additional variable to account for in laying down a consistent volume of solution over the length of a substrate. Dies accordingly will not leak when used as desired. As such, when used in combination with one or more pumps having a predictable output very precise control of the amount of solution being laid-down upon webbing by merely controlling the output of the pump.

Figure 8:
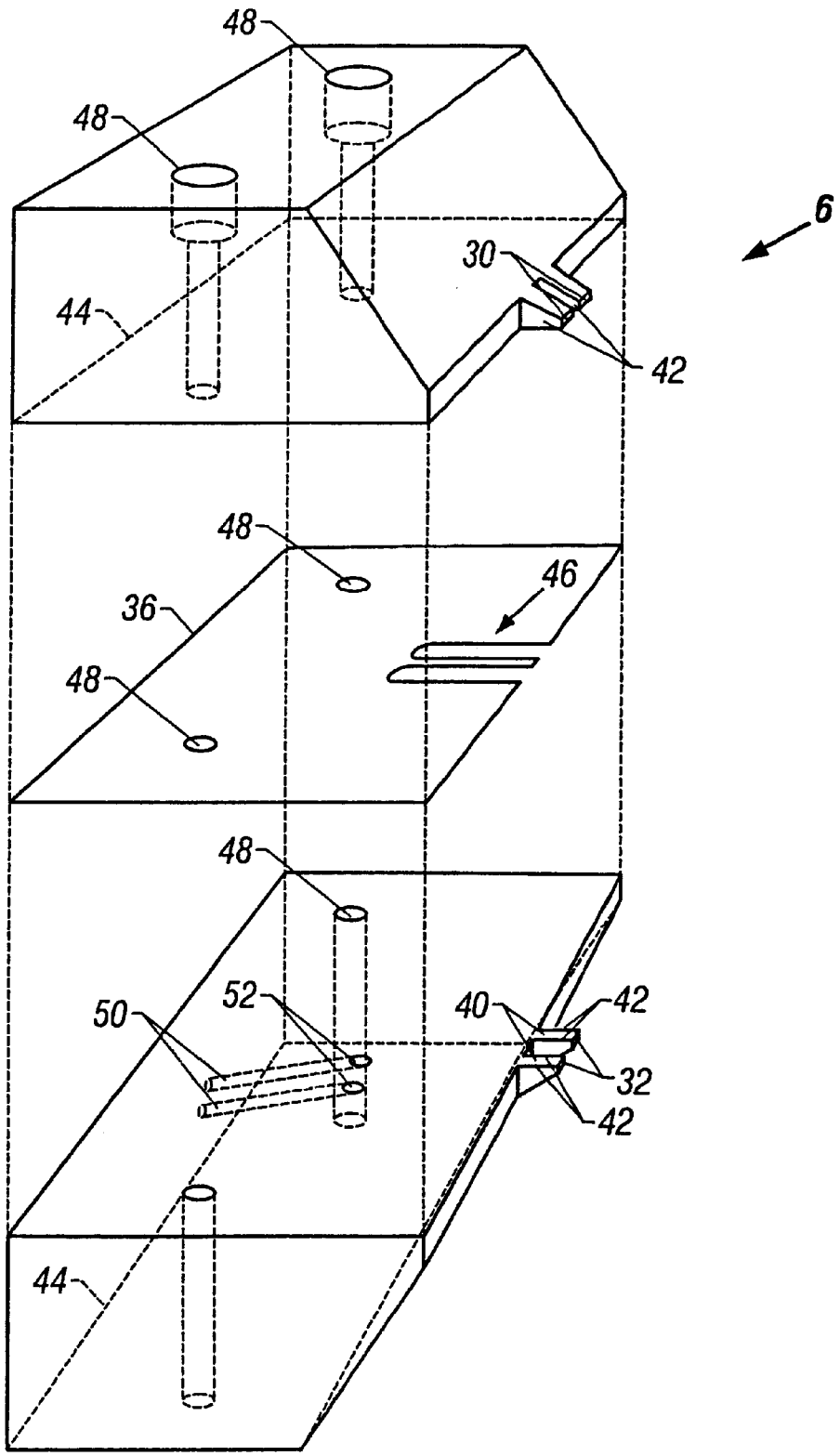
FIG. 8 shows and exploded perspective view of a variation of the inventive die.

In the die construction shown in FIG. 8, capillaries are formed along the shim/die body portion boundaries. When oriented horizontally, or at such an angle that drainage of the capillaries does not occur, the full advantages of the die are realized. Once any capillaries in communication with solution (10) are filled, a one-for-one correlation between pump delivery and solution striping is achieved facilitation consistent reagent striping of webbing (8).

However the die is constructed to avoid leakage, the mouth portions terminate in lip portions (30). Preferably, the lips are oriented perpendicular to a flow directing surface of the mouth portions and include lip edges (32) aligned with one another. The lip edge of each mouth portion is preferably set between about 0.10 and 0.50 in (2.5 and 12.7 mm) beyond the body of the die. In FIGS. 5 and 6, such extension of the mouth from the die body is shown as distance (d). The lips are preferably flat sections having a height between about 0.010 and 0.075 in (0.25 to 2 mm). Most preferably, they are about 0.050 in (1.3 mm) tall. When a shim is used to define a fluid delivery groove(s) and outlet(s), it will typically range in thickness from about 0.001 to 0.007 in (25 to 178 $\mu$m). A 0.003 in (76 $\mu$m) shim is preferably used. As configured, the shim height also sets the separation between mouth portions. Usually, the fluid directing surfaces of the mouth portions are substantially parallel. Even when no shim is used, the spacing between mouth portions or lip edges is between about 0.001 and 0.007 in (0.03 to 18 mm), preferably about 0.003 in (0.08 mm) apart. Mouth width (w) may vary greatly, however, a width of about 0.050 to 0.200 in (1.3 to 5 mm) is preferred for slot coating reagent test strip material. Most preferably, any outlet leading to a mouth will be even with or centered with respect to the mouth and have an inset (i) up to about 0.050 in (1.3 mm) on each side.

Surfaces directing the flow of solution should have a fine finish so as to avoid producing turbulent solution flow. Furthermore, at least the mouth portions of the die in contact with fluid should have edges that are fine or sharp enough to effectively guide or confine solution flow. These portions include lip edges (32) and lateral mouth portions (42).

Various forms of product may be produced in utilizing features of the invention. FIG. 9 shows a test strip precursor (54) in card for making electrochemical test strips. It comprises substrate or webbing material (8) as shown in FIG. 4 cut in two between the reagent stripes to form two 2.125 in (53.1 mm) wide cards further modified with notches (56) as shown. The precursor may further comprise an opposing webbing (58) and a spacer (60) therebetween. Each are shown as cut, punched or stamped to define test strip ends (62).

A continuous process (e.g., one in which various rolls of material are brought together to produce the precursor) such as in a continuous web process, or a discontinuous process (e.g., one in which the strip portions are first cut and then joined to each other) may be employed working with the precursor pieces. Other modes of multiple-component strip fabrication may also be employed.

The spacer preferably comprises a double-stick adhesive product. It may be fabricated from any convenient material, where representative materials include PET, PETG, polyimide, polycarbonate and the like. Webbing (8) is preferably plastic with sputtered-on palladium and functions as a "working" electrode, while webbing (58) is preferably gold coated plastic and functions as a "reference" electrode. Each webbing portion may have a thickness ranging from about 0.005 to 0.007 in (127 to 178 $\mu$m).

The test strip precursor may be in the form of a continuous tape or be in the form of a basic card (e.g., a parallelogram or analogous shape of shorter length) prior to the production stage shown in FIG. 9. As such, the length of the test strip precursor may vary considerably, depending on whether it is in the form of a tape or has a shorter shape (i.e., in the form of a card). The width of the test strip precursor may also vary depending on the nature of the particular test strip to be manufactured. In general the width of the test strip precursor (or coated substrate alone) may range from about 0.5 to 4.5 in (13 to 114 mm). It may, of course, be wider, especially to accommodate additional stripes of solution.

As alluded to above, the width and depth of solution coating applied to substrate or webbing (8) may also vary depending on the nature of the product to be manufactured. For test strip production, the striping width will typically range from about 0.05 to 0.5 in (1.3 to 13 mm) and its thickness range from about 5 to 50 microns. Especially for use in electrochemical test strips, stripes or bands of aqueous reagent material are most preferably laid down in widths about 0.065 to 0.200 in (1.7 to 5.1 mm) wide and between about 15 and 25 microns deep when wet.

After being cut into a card, like that shown in FIG. 9, precursor (54) is singulated to produce individual test strips (62). Like the precursor, test strips may be cut manually or by automated means (e.g., with a laser singulation means, a rotary die cutting means, etc.). The precursor may be cut in stages as shown and described, or in a single operation. Patterns used for cutting may be set by a program, guide, map, image or other direction means that directs or indicates how the test strip precursor should be cut into the reagent test strips. The pattern may or may not be visual on the test strip blank prior to cutting/singulation. Where the pattern is visible, the image may be apparent from a complete outline, a partial outline, designated points or markings of a strip. For further details as to how test strips may be manufactured, see U.S. patent application Ser. No. 09/737,179 titled "Method of Manufacturing Reagent Test Strips."

Figure 10:
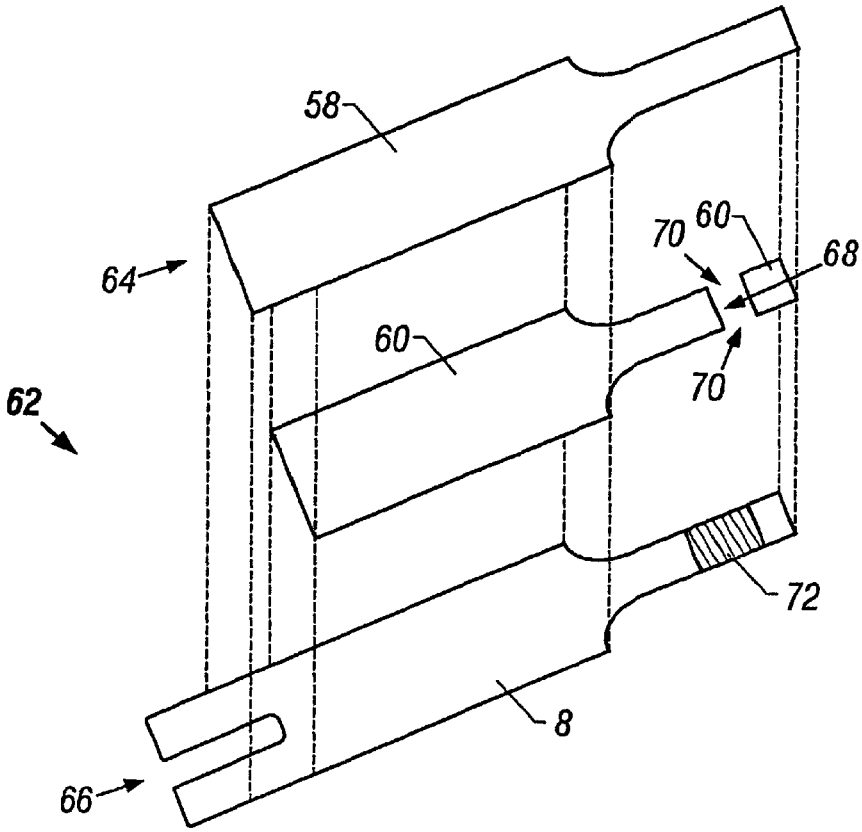
FIG. 10 shows an exploded perspective view of a test strip made using the present invention.

FIG. 10 shows an exploded view of a single representative electrochemical test strip (62). The subject test trip comprising a reference electrode (64) and a working electrode (66) separated by spacer member (60) which is cut away to define a reaction zone or area (68) in communication with side ports (70) defined by a break in the spacer's coverage adjacent reagent patch (72) formed from a dried solution stripe.

To use such an electrochemical test strip, an aqueous liquid sample (e.g., blood) is placed into the reaction zone. The amount of physiological sample that is introduced into the reaction area of the test strip may vary, but generally ranges from about 0.1 to 10 $\mu$l, usually from about 0.3 to 0.6 $\mu$l. The sample may be introduced into the reaction area using any convenient protocol, where the sample may be injected into the reaction area, allowed to wick into the reaction area, or be otherwise introduced through the ports.

The component to be analyzed is allowed to react with the redox reagent coating to form an oxidizable (or reducible) substance in an amount corresponding to the concentration of the component to be analysed (i.e., analyte). The quantity of the oxidizable (or reducible) substance present is then estimated by an electrochemical measurement.

The measurement that is made may vary depending on the particular nature of the assay and the device with which the electrochemical test strip is employed (e.g., depending on whether the assay is coulometric, amperometric or potentiometric). Measurement with the strip (62) is preferably accomplished by way of a meter probe element inserted between the electrode members to contact their respective interior surfaces. Usually, measurement is taken over a given period of time following sample introduction into the reaction area. Methods for making electrochemical measurements are further described in U.S. Pat. Nos. 4,224,125; 4,545,382; and 5,266,179; as well as WO 97/18465 and WO 99/49307 publications.

Following detection of the electrochemical signal generated in the reaction zone, the amount of the analyte present in the sample is typically determined by relating the electrochemical signal generated from a series of previously obtained control or standard values. In many embodiments, the electrochemical signal measurement steps and analyte concentration derivation steps, are performed automatically by a device designed to work with the test strip to produce a value of analyte concentration in a sample applied to the test strip. A representative reading device for automatically practicing these steps, such that user need only apply sample to the reaction zone and then read the final analyte concentration result from the device, is further described in copending U.S. application Ser. No. 09/333,793 filed Jun. 15, 1999.

The reaction zone in which activity occurs preferably has a volume of at least about 0.1 $\mu$l, usually at least about 0.3 $\mu$l and more usually at least about 0.6 $\mu$l, where the volume may be as large as 10 $\mu$l or larger. The size of the zone is largely determined by the characteristics of spacer (60). While the spacer layer is shown to define a rectangular reaction area in which the aforementioned activity occurs, other configurations are possible, (e.g., square, triangular, circular, irregular-shaped reaction areas, etc.). The thickness of the spacer layer generally ranges from about 0.001 to 0.020 in (25 to 500 $\mu$m), usually from about 0.003 to 0.005 in (76 to 127 $\mu$m). The manner in which the spacer is cut also determines the characteristics of ports (70). The cross-sectional area of the inlet and outlet ports may vary as long as it is sufficiently large to provide an effective entrance or exit of fluid from the reaction area.

As depicted, the working and reference electrodes are generally configured in the form of elongate strips. Typically, the length of the electrodes ranges from about 0.75 to 2 in (1.9 to 5.1 cm), usually from about 0.79 to 1.1 in (2.0 to 2.8 cm). The width of the electrodes ranges from about 0.15 to 0.30 in (0.38 to 0.76 cm), usually from about 0.20 to 0.27 in (0.51 to 0.67 cm). In certain embodiments, the length of one of the electrodes is shorter than the other, wherein in certain embodiments it is about 0.135 in (3.5 mm) shorter. Preferably electrode and spacer width is matched where the elements overlap. In a most preferred embodiment, electrode (64) is 1.365 in (35 cm) long, electrode (66) is 1.5 in (3.8 cm) long, and each are 0.25 in (6.4 mm) wide at their maximum and 0.103 in (2.6 mm) wide at their minimum, reaction zone (68) and ports (70) are 0.065 in (1.65 mm) wide and the reaction zone has an area of about 0.0064 in$^2$ (0.041 cm$^2$). The electrodes typically have a thickness ranging from about 10 to 100 nm, preferably between about 18 to 22 nm. The spacer incorporated in the strip is set back 0.3 in (7.6 mm) from the end electrode (66), leaving an opening between the electrodes that is 0.165 in (4.2 mm) deep.

Test strips according to the present invention may be provided in packaged combination with means for obtaining a physiological sample and/or a meter or reading instrument such as noted above. Where the physiological sample to be tested by a strip is blood, the subject kits may include a tool such as a lance for sticking a finger, a lance actuation means, and the like. Further, test strip kits may include a control solution or standard (e.g., a glucose control solution that contains a standardized concentration of glucose). Finally, a kit may include instructions for using test strips according to the invention in the determination of an analyte concentration in a physiological sample. These instructions may be present on one or more of container(s), packaging, a label insert or the like associated with the subject test strips.

EXAMPLE

For use in test strips or otherwise, the following results have been observed in connection with the present invention. With solution having properties like the preferred solution indicated above, deposited on Pd coated plastic webbing running at 25 ft/min, coating tests were run in triplicate with various dies, with measurements taken at the beginning middle and end of three foot webbing section prepared from the middle of 15 second runs. Flow parameters and die/webbing spacing were set in effort to achieve the most consistent solution stripe coating results possible with each die setup. In order to get a stable indication of stripe width variability, the samples were dried using identical conditions with the above-referenced "Solution Drying System" and then measured using an Avant Vision Measurement System produced by Optical Gaging Products (Rochester, N.Y.).

Figure 11:
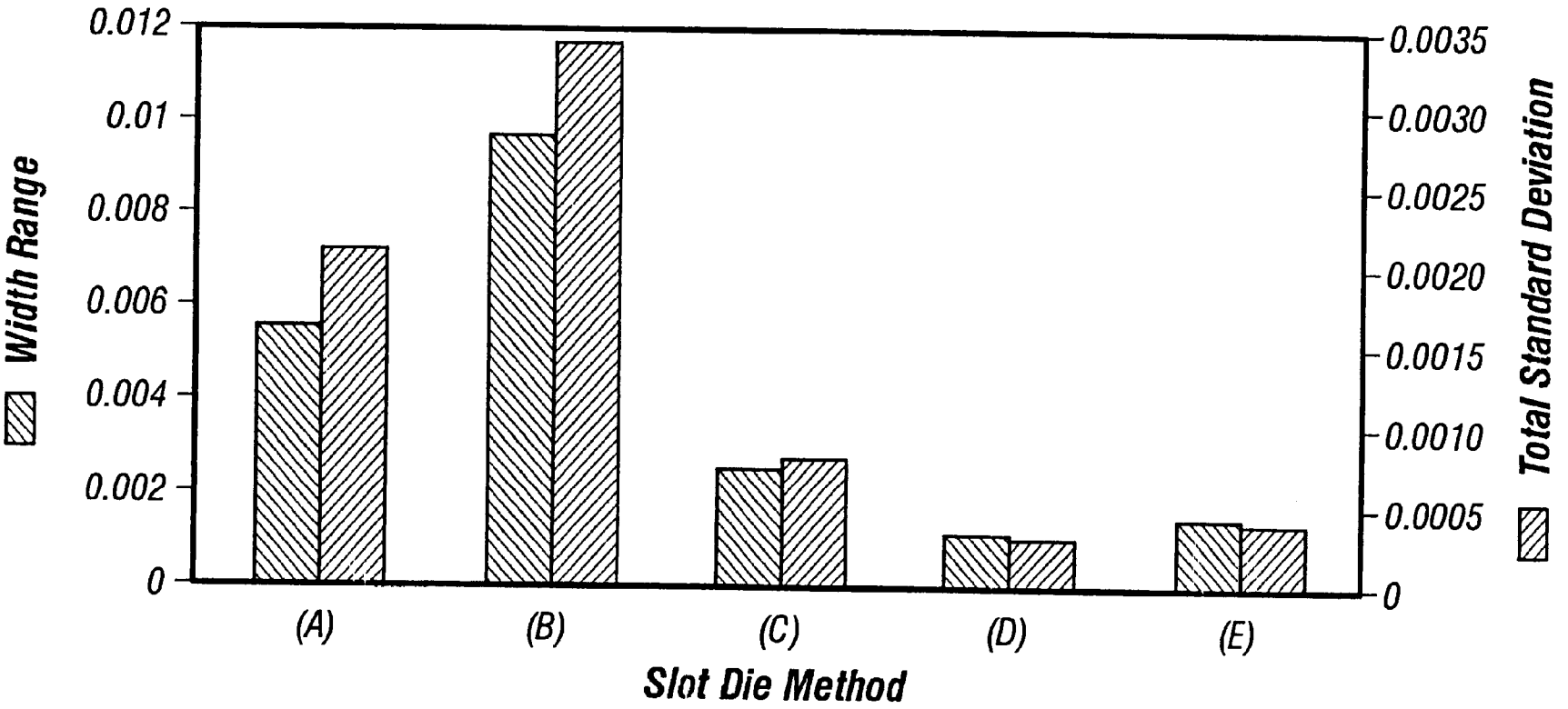
FIG. 11 is a bar graph presenting data obtained by the Example provided herein.

First, a standard Liberty-type die having a 0.003×0.18 in (76 $\mu$m×4.6 mm) gap for delivering solution was tested. For stripes having a dried width averaging about 0.180 in (4.6 mm), the total Standard Deviation (SD) produced was 0.0021 in (533 $\mu$m). The overall variation in width was observed to be about 0.0554 in (1.41 mm). These results are graphically represented in FIG. 11 as graph bars (A).

Second, a standard Liberty die, modified in accordance with the teaching in the '437 patent, utilizing a two-shim approach as shown therein was tested. A spacer shim corresponding to element (44) in the referenced patent was used with its thickness set at 0.003 in (76 $\mu$m) and extensions corresponding to element (58) were set at 0.010 in (2.5 mm)—a setup described in the '047 patent to be one "particularly effective under a variety of coating conditions." The extension width was set to 0.18 in (4.6 mm). With this setup, stripes of dried test solution were produced having an average width of about 0.179 in (4.5 mm) and a total SD of 0.0034 in (864 $\mu$m). An overall variability in width of about 0.00962 in (2.44 mm) was observed. These results are graphically represented in FIG. 11 as graph bars (B).

Third, a setup similar the second except with a spacer 0.003 in (76 $\mu$m) thick with an extension 0.020 in (510 $\mu$m) long produced stripes having an average width of about 0.168 in (4.3 mm) with a total SD of 0.0008 in (20 $\mu$m).

Variability in width of about 0.00236 in (60 μm) resulted. These results are graphically represented in FIG. 11 as graph bars (C).

Fourth, using a relieved die according to the present invention, such as illustrated in FIG. 9, with lips (30) extended 0.030 in (7.6 mm) from aid body/face, a 0.003 in (76 μm) thick shim, 0.018 in (4.6 mm) wide mouth and 0.050 in (1.3 mm) tall lip flats, an average dried stripe width of 0.172 in (4.4 mm) with a total SD at 0.0003 in (7.6 μm) was produced. Overall variability in stripe width was about 0.00088 in (22 μm). These results are graphically represented in FIG. 11 as graph bars (D).

Finally, a Troller-type die with wider lip flats than the fourth exemplar die, but otherwise similarly setup, produced an average test stripe width of 0.020 in (5.1 mm) with a total SD at 0.0004 in (10 μm). Variability in dried stripe width for in and out testing as described produced width variation of 0.00123 in (31 μm). These results are graphically represented in FIG. 11 as graph bars (E).

The results generated with the die of the present invention and the Troller die as compared to those offered by a die produced in accordance with the approach described in the '437 clearly demonstrates the surprising superiority of using a pair of opposed solution directing surfaces over a single-surface approach. The inventive die demonstrates strikingly superior stripe width consistency as quantified by the SD and overall width consistency values.

The performance of the Troller die proved more comparable to the inventive die. However, its performance did quite match that of the inventive die. It is believed the relative handicap in performance is either a function of difficult or imprecise die assembly, the aforementioned leakage (giving rise to other problems as well) or a combination of these factors.

Finally, it is noted that experience in setup indicates that the inventive die can tolerate greater variability in die/webbing spacing(s) without adversely affecting stripe width (or actually breading the bead of solution being applied) than any of the other die setups tested. Such a "robust" die quality is useful to account for inconsistencies in advancing and setting a die in proximity to webbing as well as dealing with run out or lack of concentricity of a baking roller supporting webbing to be coated.

Though the invention has been described in reference to a single example, optionally incorporating various features, the invention is not to be limited to the set-up described. The invention is not limited to the uses noted or by way of the exemplary description provided herein. It is to be understood that the breadth of the present invention is to be limited only by the literal or equitable scope of the following claims.

That being said, we claim:

1. A method of coating material with stripes of solution comprising:

providing a moving web of material, advancing a multi-piece die to a position adjacent said material, said die comprising a body and at least one mouth, said body adapted for passing solution from a source, through an outlet for each said mouth, each said mouth comprising a pair of portions having substantially flat, substantially parallel solution directing surfaces extending beyond said body and each said outlet, and being open along side portions, each said mouth portion terminating in at lip having an edge, said edges being substantially in alignment with one another and forming a gap, said die being adapted to avoid solution leakage;

then extruding solution through said die, past said lips, and producing at least one stripe of coating on said material.

2. The method of claim 1, wherein said lips are advanced within about 0.001 in of said material.

3. The method of claim 1, wherein said solution is a reagent solution.

4. The method of claim 1, wherein said solution has a viscosity under about 5 centipoises.

5. The method of claim 1, wherein said solution has a viscosity between about 1 and 2 centipoises.

6. The method of claim 1, further comprising drying said at least one stripe of coating.

7. The method of claim 6, further comprising forming cutting said web of material to form individual test strips.

* * * * *